US005876248A

United States Patent [19]

Brunker et al.

[11] Patent Number: 5,876,248

[45] Date of Patent: Mar. 2, 1999

[54] MATABLE ELECTRICAL CONNECTORS HAVING SIGNAL AND POWER TERMINALS

[75] Inventors: David L. Brunker, Naperville; Maxwill P. Bassler, Hampshire, both of Ill.; Michael J. Gardner, Pleasanton, Calif.; Russell J. Leonard, Naperville, Ill.

[73] Assignee: Molex Incorporated, Lisle, Ill.

[21] Appl. No.: 783,418

[22] Filed: Jan. 14, 1997

[51] Int. Cl.[6] ..... H01R 13/648

[52] U.S. Cl. ..... 439/608; 439/660

[58] Field of Search ..... 439/608, 101, 439/108, 609, 941, 660

[56] References Cited

U.S. PATENT DOCUMENTS

| | | | |
|---|---|---|---|
| 5,102,353 | 4/1992 | Brunker et al. | 439/608 |
| 5,190,462 | 3/1993 | Lauchner et al. | 439/65 |
| 5,197,893 | 3/1993 | Morlion et al. | 439/608 |
| 5,429,520 | 7/1995 | Morlion et al. | 439/108 |
| 5,429,521 | 7/1995 | Morlion et al. | 439/108 |
| 5,433,617 | 7/1995 | Morlion et al. | 439/108 |
| 5,433,618 | 7/1995 | Morlion et al. | 439/108 |
| 5,518,422 | 5/1996 | Zell et al. | 439/608 |
| 5,542,851 | 8/1996 | Chikano | 439/108 |
| 5,547,405 | 8/1996 | Pinney et al. | 439/894 |
| 5,549,481 | 8/1996 | Morlion et al. | 439/108 |
| 5,632,635 | 5/1997 | Vanbesien et al. | 439/108 |

FOREIGN PATENT DOCUMENTS

| | | | |
|---|---|---|---|
| 6-215829 | 8/1994 | Japan | H01R 13/658 |
| 7-161414 | 6/1995 | Japan | H01R 13/658 |

*Primary Examiner*—Paula Bradley
*Assistant Examiner*—Tho D. Ta
*Attorney, Agent, or Firm*—Charles S. Cohen

[57] ABSTRACT

An electrical connector is provided for mating with a complementary connector. The electrical connector includes a dielectric housing having a mating portion. A cross-shaped ground plate structure is disposed in the mating portion of the housing when the electrical connector is mated with the complementary connector. The cross-shaped ground plate structure defines four plate edges and four quadrants. At least one terminal is mounted in the mating portion of the housing in at least some of the quadrants defined by the cross-shaped ground plate structure. A pair of outboard terminals are mounted in the mating portion of the housing outside a pair of the plate edges of the cross-shaped ground plate structure.

18 Claims, 8 Drawing Sheets

MATABLE ELECTRICAL CONNECTORS HAVING SIGNAL AND POWER TERMINALS

FIELD OF THE INVENTION

This invention generally relates to the art of electrical connectors and, particularly, to an electrical connector system having grounded connectors.

BACKGROUND OF THE INVENTION

Electrical connectors are used in a wide variety of applications. Some connectors simply are used to transmit power from a power source to an appropriate appliance. Other electrical connectors are used to interconnect signal transmission lines to printed circuit boards, other electronic devices or to other complementary connectors. The transmission lines transmit signals through a plurality of conductors which, preferably, are physically separated and electromagnetically isolated along their length. Hybrid connectors are known in which both power and signals and/or data are transmitted through the connector interface.

Some electrical connectors also employ various types of shield means, ground means or the like to protect or electrically interact with the transmission lines and their terminals within the connectors. For instance, ground planes or plates might be used to simply shield or protect the terminals/transmission lines internal to the transmission system from receiving or transmitting electromagnetic or radio interference from outside the transmission system. On the other hand, ground planes or plates may be used to control "crosstalk" (electrical noise induced by mutual coupling) between adjacent conductors or terminals within the transmission system. Sometimes this is referred to as controlling the mutual coupling of conductors or terminals. The present invention is directed to the use of ground planes, plates or the like in the latter sense of controlling the mutual coupling of electrical conductors, particularly the terminals within an electrical connector.

For instance, U.S. Pat. No. 5,102,353, dated Apr. 7, 1992; U.S. Pat. No. 5,304,069, dated Apr. 19, 1994 and U.S. Pat. No. 5,344,327, dated Sep. 6, 1994, all show electrical connectors with a "cross-shaped" ground plate means at the interface between a pair of mated electrical connectors. The cross-shaped ground plate means may be provided by a one-piece cross-shaped conductive ground member in one connector of a mating pair of connectors. On the other hand, the cross-shaped ground plate means may be formed by a pair of perpendicular, interposed ground plates, with one of the plates being on one of the mating connectors and the other plate being on the other connector. In any event, the cross-shaped ground plate means defines four plate edges with four quadrants therebetween. At least one terminal is located in each of the quadrants. Therefore, the cross-shaped ground plate means provide an enhanced mutual coupling effect with the terminals and substantially eliminates crosstalk or mutual coupling between the terminals.

The present invention is directed to an improved grounded terminal array, particularly using a cross-shaped ground plate means of the character described above. Consequently, the above-referenced U.S. patents are incorporated herein by reference.

SUMMARY OF THE INVENTION

An object, therefore, of the invention is to provide a new and improved terminal and ground plane configuration in an electrical connector.

In the exemplary embodiment of the invention, a shielded electrical connector is disclosed for mating with a complementary connector along a mating axis. A dielectric housing includes a mating portion. An outer conductive shield surrounds at least the mating portion of the housing. A cross-shaped ground plate structure is disposed in the mating portion of the housing when the electrical connector is mated with the complementary connector. The cross-shaped ground plate structure defines four plate edges and four quadrants therebetween. At least one terminal typically designated for high speed signaling is mounted in the mating portion of the housing in at least some of the quadrants defined by the cross-shaped ground plate structure. A pair of outboard power terminals are mounted in the mating portion of the housing outside an opposite pair of the plate edges of the cross-shaped ground plate structure.

As disclosed herein, the shielded electrical connector is a right-angled connector, and the terminals have right-angled portions extending generally perpendicular to the mating axis of the connectors. The cross-shaped ground plate structure includes a first ground plate extending in the direction of the mating axis and in a plane generally parallel to the right-angled configuration and a second ground plate extending in the direction of the mating axis in a plane generally perpendicular to the right-angled configuration. The pair of outboard terminals are located outside the plate edges of the second ground plate.

In a terminal array as disclosed herein, the terminals located in the quadrants of the cross-shaped ground plate structure are signal terminals. The outboard terminals outside the edges of the cross-shaped ground plate structure may be power terminals.

Still further, in one embodiment of the invention, the pair of outboard terminals is located on a line coincident with the pair of opposite plate edges of the ground plate structure. In another embodiment, a pair of outboard terminals is mounted in the mating portion of the housing outside each of the pair of opposite plate edges.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
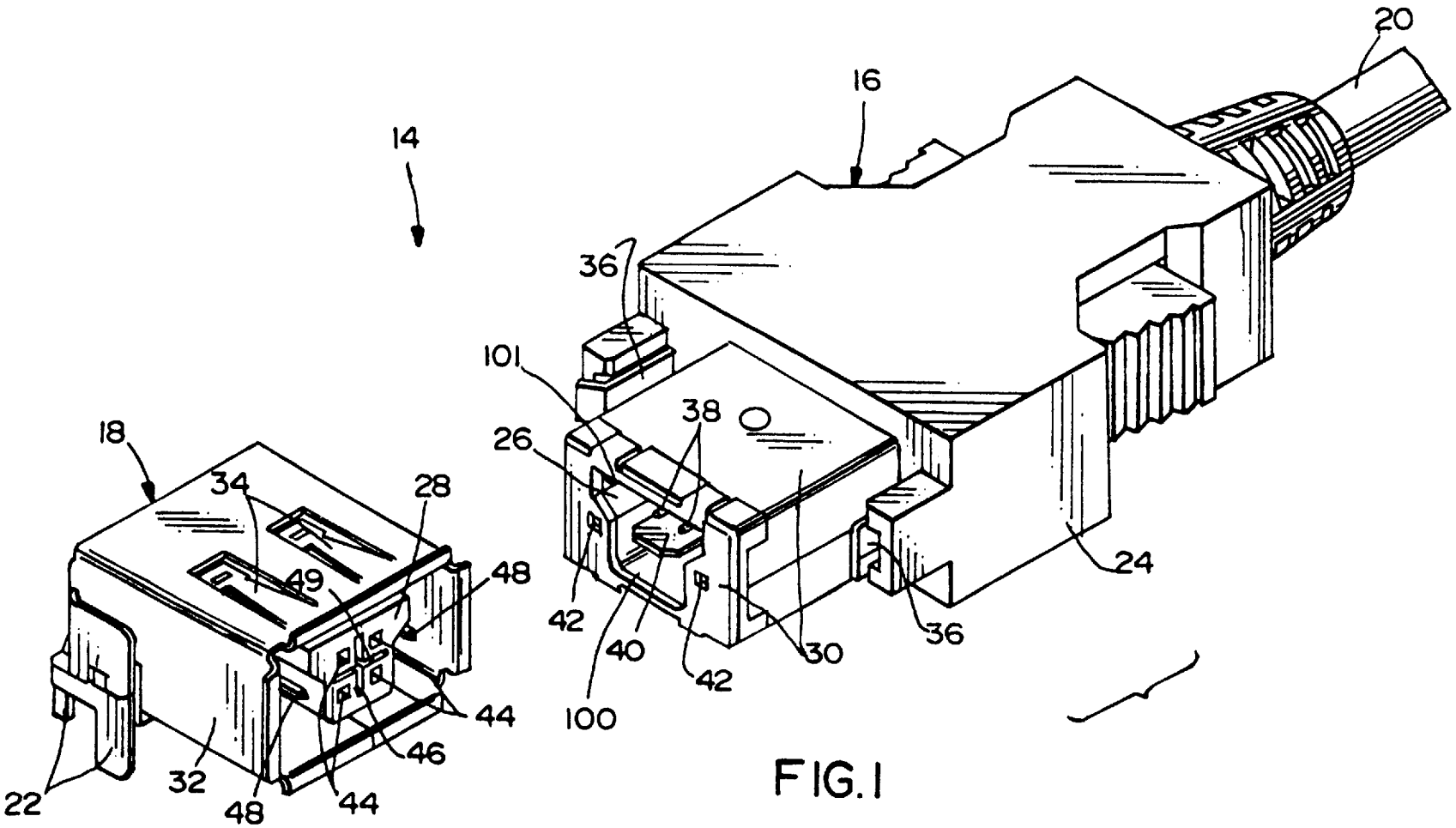
FIG. 1 is a perspective view of a first embodiment of a connector assembly, including plug and receptacle connectors, incorporating the concepts of the invention.

Referring to the drawings in greater detail, and first to FIG. 1, a first embodiment of an electrical connector assembly, generally designated 14, includes a plug connector, generally designated 16, and a receptacle connector, generally designated 18. Plug connector 16 is adapted for terminating the conductors of an electrical cable 20, and receptacle connector 18 has board mounting feet 22 for mounting on a printed circuit board (not shown). Therefore, with plug connector 16 mated with receptacle connector 18 on the printed circuit board, connector assembly 14 is considered a right-angled electrical connector assembly.

Plug connector 16 includes a dielectric outer cover 24 and a housing having a forwardly extending mating portion 26. Receptacle connector 18 has a dielectric housing with a forwardly projecting mating portion 28. Plug connector 16 has an outer conductive shield 30 surrounding at least mating portion 26, and receptacle connector 18 has an outer conductive shield 32 surrounding at least mating portion 28. Shield 32 has spring fingers 34 for engaging the top of shield 30 to common or interconnect the shields of the mating connectors when mated. Plug connector 16 has latches 36 for holding the connectors in mated condition.

Figure 3:
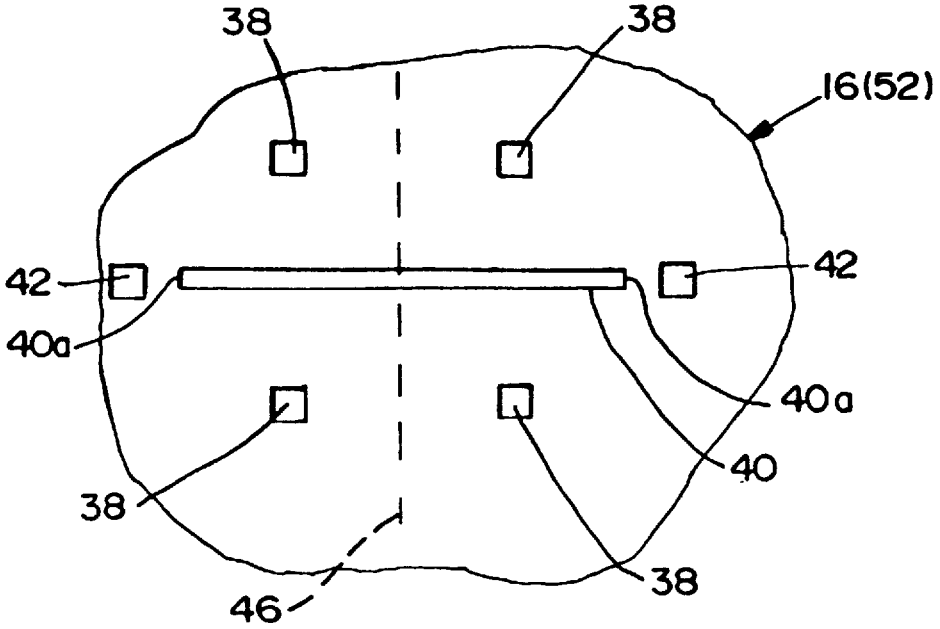
FIG. 3 is a schematic illustration of the terminal array and ground plate within the plug connectors.
Figure 4:
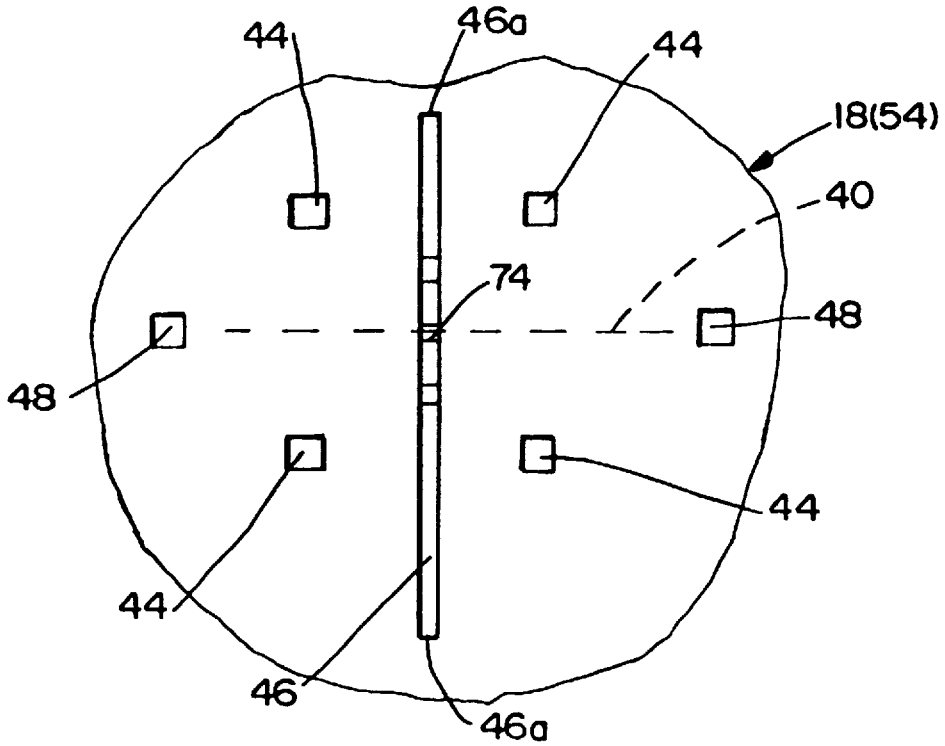
FIG. 4 is a view similar to that of FIG. 3, but showing the terminal array and ground plate within the receptacle connectors.

In anticipation of a more detailed description of the terminal and ground plane array in reference to FIGS. 3 and 4, suffice it to say that plug connector 16 has four signal pin terminals 38, two on each opposite side of a horizontal ground plate 40, with a pair of outboard male power terminals 42 located outside opposite edges of ground plate 40. Receptacle connector 18 has four female signal terminals 44, two on opposite sides of a vertical ground plate 46, and two outboard power terminal pins 48 for mating with the outboard power terminals 42 of plug connector 16. A horizontal slot 49 is formed in mating portion 28 intersecting vertical ground plate 46 for receiving horizontal ground plate 40 of plug connector 16.

Figure 2:
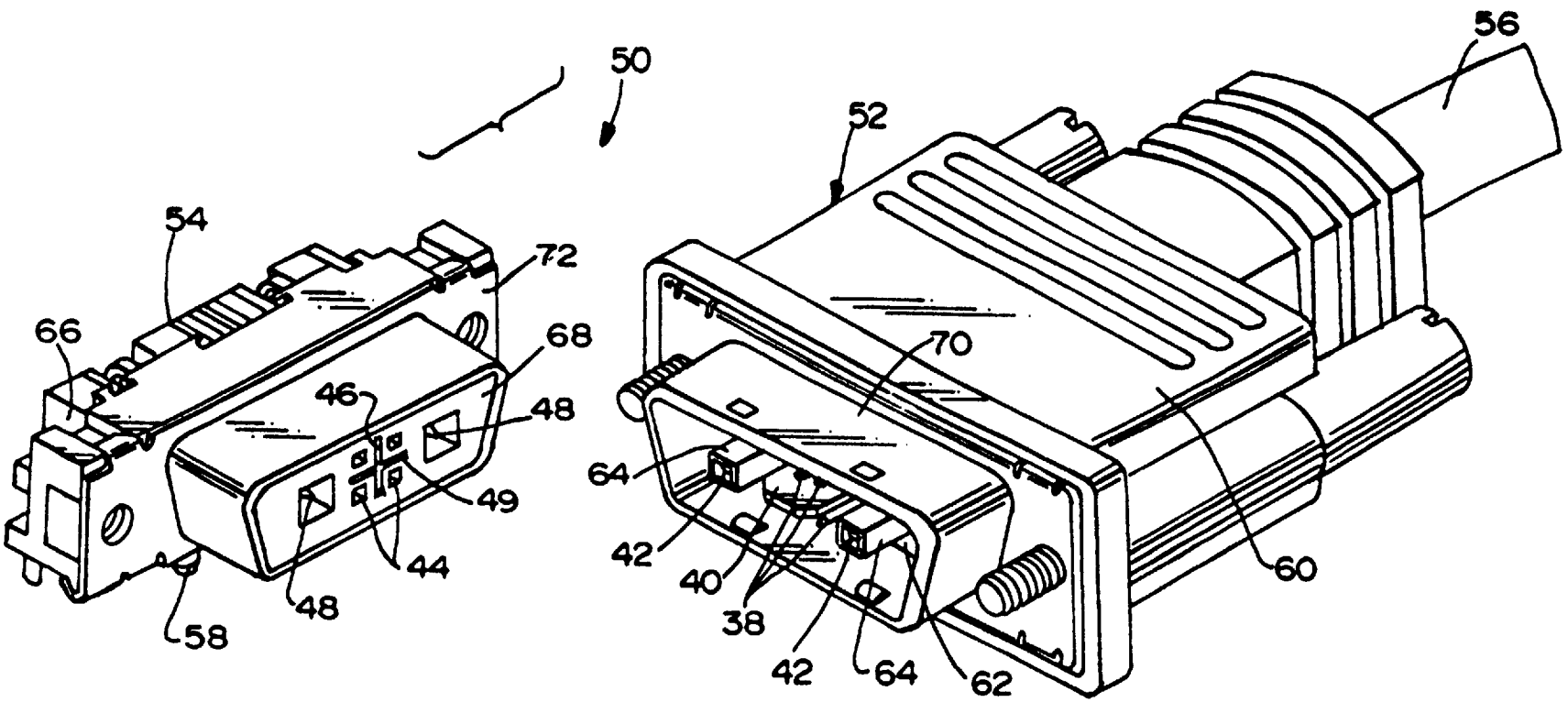
FIG. 2 is a perspective view of a second embodiment of a connector assembly, including plug and receptacle connectors, incorporating the concepts of the invention.

Referring to FIG. 2, a second embodiment of an electrical connector assembly, generally designated 50, includes a plug connector, generally designated 52, and a receptacle connector, generally designated 54. Like plug connector 16 (FIG. 1), plug connector 52 is adapted for terminating the conductors of an electrical cable 56. Like receptacle connector 18 (FIG. 1), receptacle connector 54 includes mounting feet 58 for mounting the connector on a printed circuit board (not shown). Therefore, like connector assembly 14 (FIG. 1), connector assembly 50 is a right-angled electrical connector system.

Plug connector 52 includes a dielectric outer cover 60 and a housing having a mating portion 62 including forwardly projecting silos 64, and receptacle connector 54 has a dielectric housing 66 and a forwardly projecting, generally D-shaped mating portion 68. Plug connector 52 has a D-shaped outer conductive shield 70 surrounding at least mating portion 62,64 and receptacle connector 54 has a D-shaped outer conductive shield 72 surrounding mating portion 68.

The terminal and ground plane array of connector assembly 50 is similar to that of connector assembly 14 (FIG. 1) and, therefore, like numerals are applied to the terminals and ground plates. Specifically, plug connector 52 has four signal pin terminals 38 mounted in the mating portion of housing 60, with two terminals on each opposite side of a horizontal ground plate 40. Outboard female power terminals 42 are mounted within silos 64 outside opposite edges of ground plate 40. Receptacle connector 54 includes four female signal terminals 44, two on each opposite side of a vertical ground plate 46. A pair of outboard power pin terminals 48 of receptacle connector 54 mate with female power terminals 42 of plug connector 52. Again, a horizontal slot 49 is formed in mating portion 68 intersecting vertical ground plate 46 for receiving horizontal ground plate 40 of plug connector 52.

FIGS. 3 and 4 better show the array of terminals and ground plates in the mating connectors of connector assembly 14 (FIG. 1) and connector assembly 50 (FIG. 2). More particularly, FIG. 3 shows signal terminals 38 on opposite sides of horizontal ground plate 40 of plug connectors 16 or 52. Power terminals 42 are termed "outboard" terminals and are located outside edges 40*a* of the ground plate. Dotted line 46 represents ground plate 46 of receptacle connectors 18 or 54.

Referring to FIG. 4, signal terminals 44 are shown on opposite sides of ground plate 46 of receptacle connectors 18 or 54. Again, dotted line 40 represents the position of ground plate 40 of plug connectors 16 or 52. Outboard power terminals 48 are shown located for mating with power terminals 42 of plug connectors 16 or 52 (i.e., outside the opposite edges of ground plate 40).

In order to mate the connectors of connector assemblies 14 and 50, vertical ground plate 46 in receptacle connectors 18 or 54 includes a slot 74 (FIG. 4) on the center line thereof for receiving the solid ground plate 40 of plug connectors 16 or 52. Therefore, when the plug connectors are mated with the receptacle connectors, a cross-shaped ground plate structure is defined by the mated ground plates 40 and 46. With this understanding, it can be seen in the illustrations of FIGS. 3 and 4 that the cross-shaped ground plate structure defined by ground plates 40 and 46 define four plate edges 40*a* (FIG. 3) and 46*a* (FIG. 4) and four quadrants therebetween. One of each of the mating signal terminals 38,44 is located in each of the four quadrants defined by the cross-shaped ground plate structure. The power terminals 42,48 are considered "outboard" terminals in that they are located outside the edges of one of the ground plates, particularly ground plate 40 shown herein.

With the terminal and ground plane array shown in FIGS. 3 and 4 and described above, a resulting mutual coupling is created between outboard power terminals 42,48 and ground plate 40 at edges 40*a* of the ground plate. This coupling does not interfere with the mutual coupling between signal terminals 38,44 and ground plates 40 and 46 of the cross-shaped ground plate structure, thereby rendering power terminals 42, 48 substantially isolated from signal terminals 38, 44.

It should be understood that the invention is not limited to a pair of interleaved ground plates, such as ground plates 40 and 46, to define a cross-shaped ground plate structure. The cross-shaped configuration equally could be provided by a one-piece ground plate in either one of the mating connectors. Both configurations are described and shown in the prior U.S. patents enumerated in the "Background" above. In addition, terminals 38,44 do not necessarily have to be signal terminals, and terminals 42,48 do not necessarily have to be power terminals. The terminal and ground plane array of the invention is equally effective to isolate any "outboard" terminals from the crosstalk or mutual coupling of the signal terminals in the quadrants of the cross-shaped ground plate structure. Further, outboard terminals can be positioned at the edges 46*a* of ground plate 46 and have the same effect as shown with the outboard terminals being located outside the edges 40*a* of ground plate 40. In fact, outboard terminals could be positioned outside any one or all of the four edges defined by the cross-shaped ground plate structure. Still further, there could be more than one terminal 38,44 in each quadrant of the cross-shaped ground plate structure, while positioning other terminals outside one or more edges of the ground plates and still effectively isolate the outboard terminals in a zone or region which is least affected by the terminals within the quadrants and, conversely, least affects the terminals within the quadrants. Finally, the concepts of the invention certainly are not limited to a right-angled connector assembly, as shown.

FIGS. 5–11 show a third embodiment of a connector assembly, generally designated 76, which includes a plug connector, generally designated 78, and a receptacle connector, generally designated 80. Again, plug 78 includes a dielectric outer cover 82 and a housing having a forwardly projecting mating portion 84, and receptacle connector 80 includes a dielectric housing having a forwardly projecting mating portion 86. Plug connector 78 includes an outer conductive shield 88 surrounding at least mating portion 84, and receptacle connector 80 includes an outer conductive shield 90 surrounding at least mating portion 86. Plug connector 78 is adapted for terminating the conductors of an electrical cable 92, and receptacle connector 80 includes mounting feet 94 for mounting the connector onto a printed circuit board (not shown). Therefore, again, connector assembly 76 is considered a right-angled configuration.

Plug connector 78 and receptacle connector 80 of connector assembly 76 again cooperate to define a cross-shaped ground plate structure with terminals in the quadrants thereof, and with "outboard" terminals outside the edges of the ground plate means. The principal difference between the array of connector assembly 76 and the arrays of connectors assemblies 14 and 50 (FIGS. 1–4) is in the number and placement of the outboard terminals.

Figure 5:
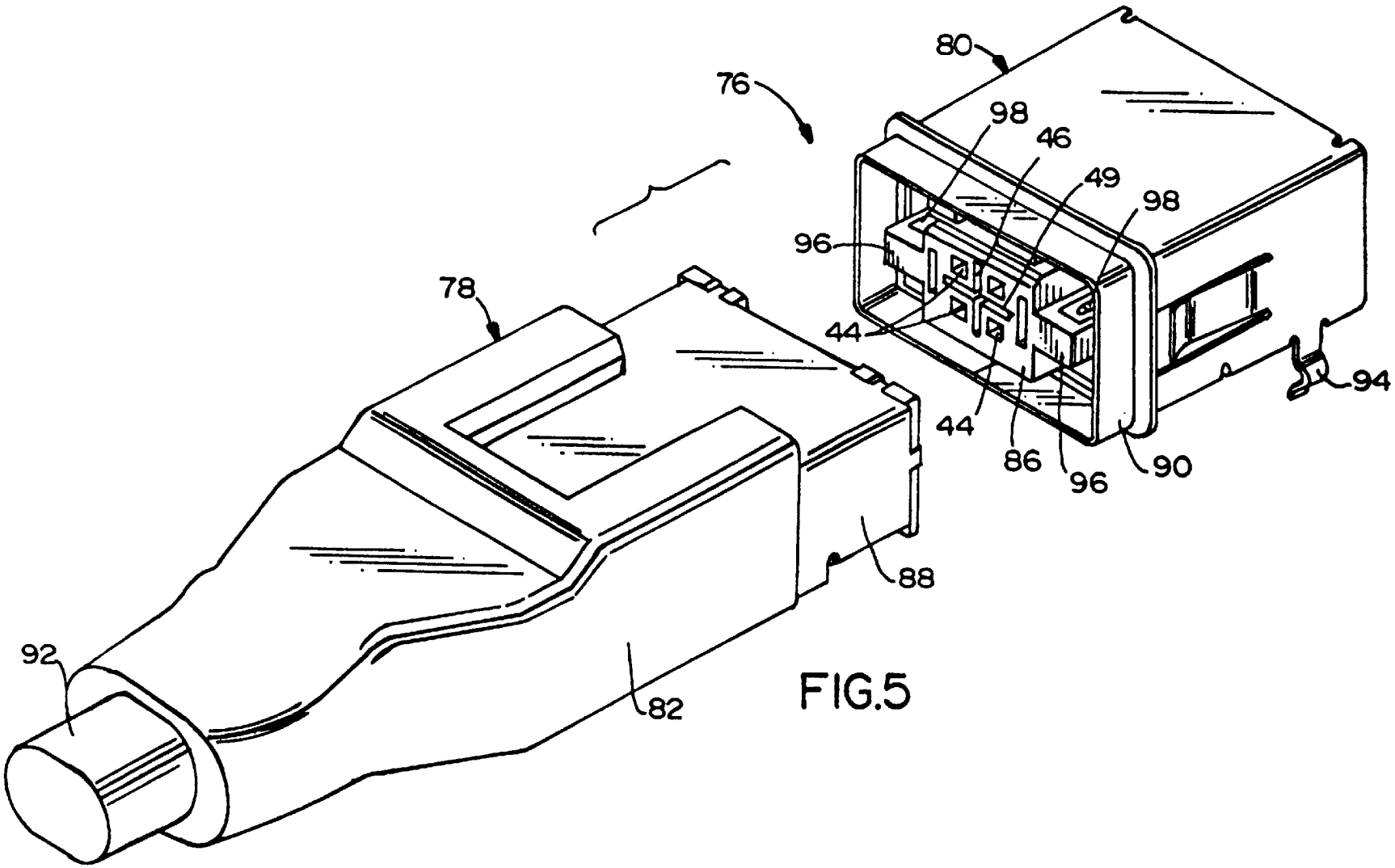
FIG. 5 is a perspective view of a third embodiment of a connector assembly, including plug and receptacle connectors, incorporating the concepts of the invention.
Figure 10:
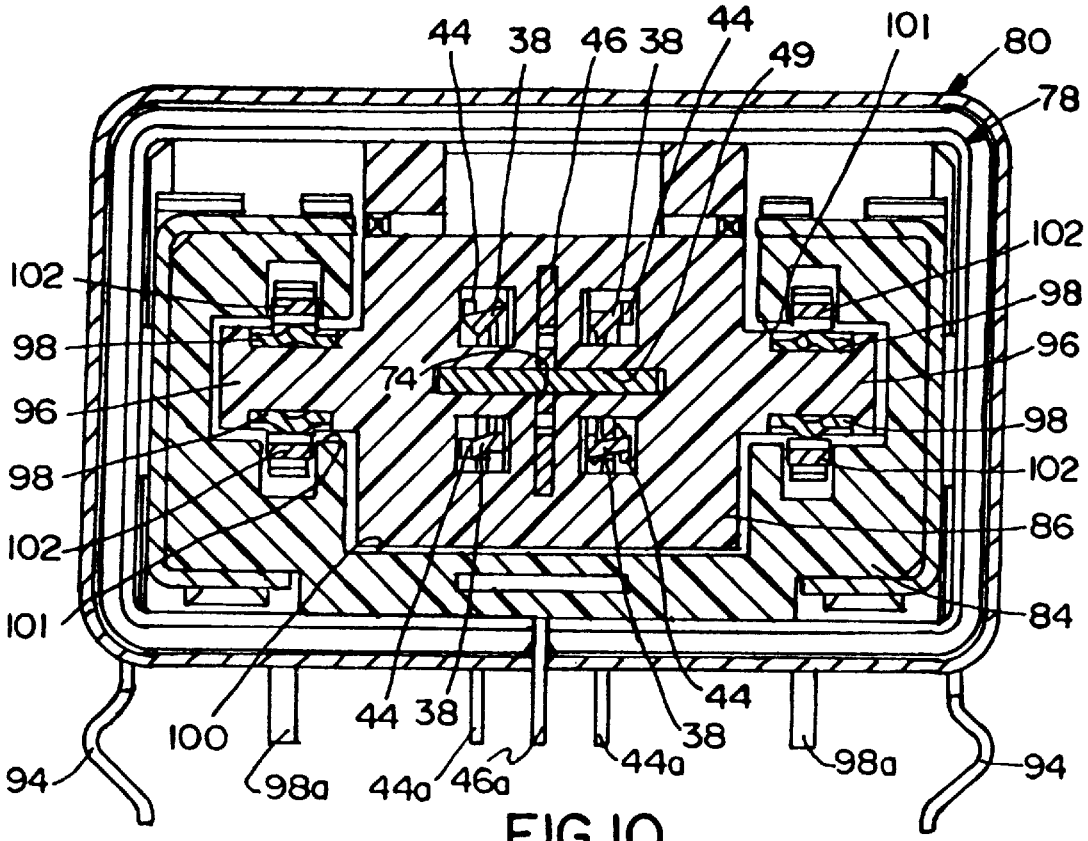
FIG. 10 is a section taken generally along line 10—10 of FIG. 7.

More particularly, FIGS. 5 and 10 best show that mating portion 86 of receptacle connector 80 is generally cross-shaped or rectangular with horizontally extending, fairly robust outboard wings 96. The mating portion mounts a vertical ground plate 46 (FIG. 10) with two female signal terminals 44 on each opposite side of the ground plate. The mating portion also includes a slot 49 for receiving the horizonal ground plate 40 of plug connector 78. Vertical ground plate 46 has a pair of right-angled tail portions 46*a* (FIGS. 8 and 10) for connection to a ground circuit trace on the printed circuit board. This also is true with ground plate 46 of connectors 18 and 54. The primary difference between the terminal array of receptacle connector 80 versus that of receptacle connectors 18 and 54 (FIGS. 1–4) is that a pair of outboard power terminals 98 are mounted on opposite sides of each of the outboard wings 96 of mating portion 86 of receptacle connector 80. Terminals 98 are of a leaf-type recessed in the surfaces of outboard wings 96 of the mating portion.

Figure 6:
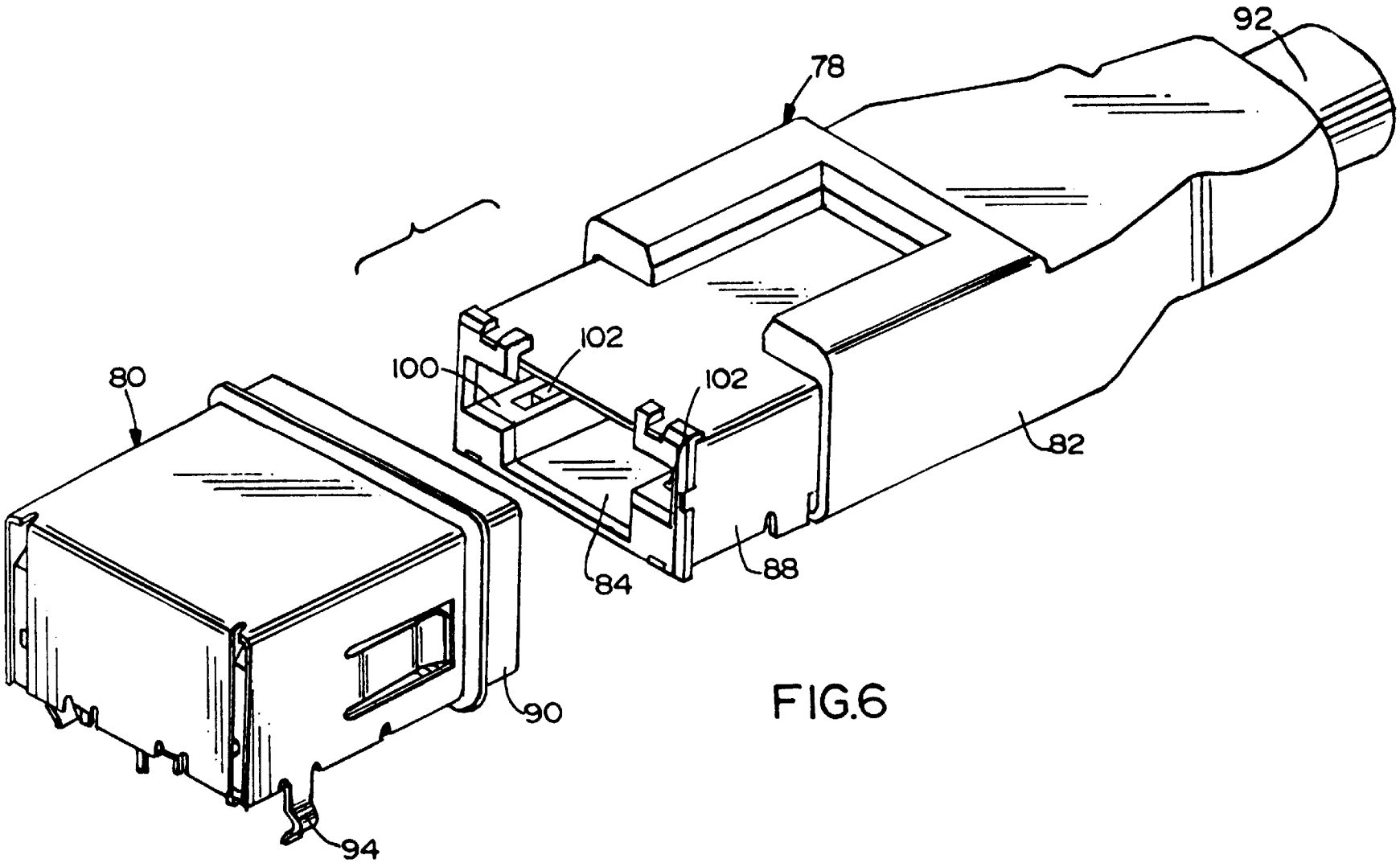
FIG. 6 is a perspective view of the connector assembly of FIG. 5, taken at an angle of 180° thereto.
Figure 7:
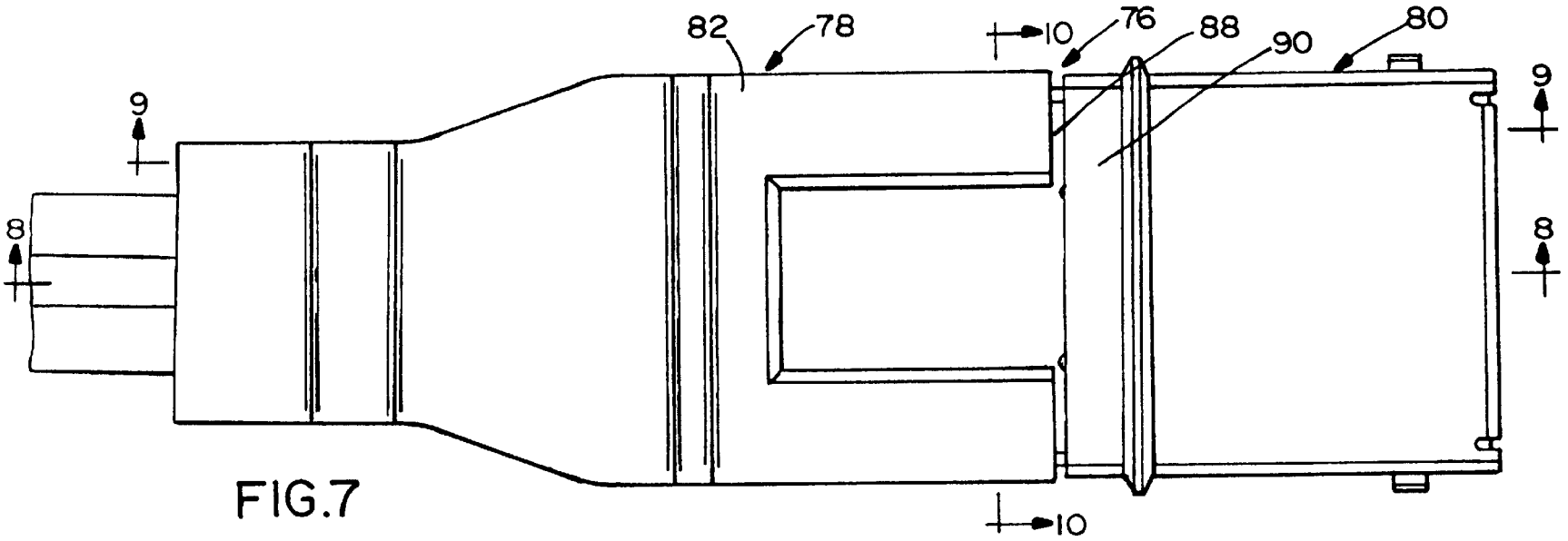
FIG. 7 is a top plan view of the connector assembly of FIGS. 5 and 6, in assembled or mated condition.
Figure 8:
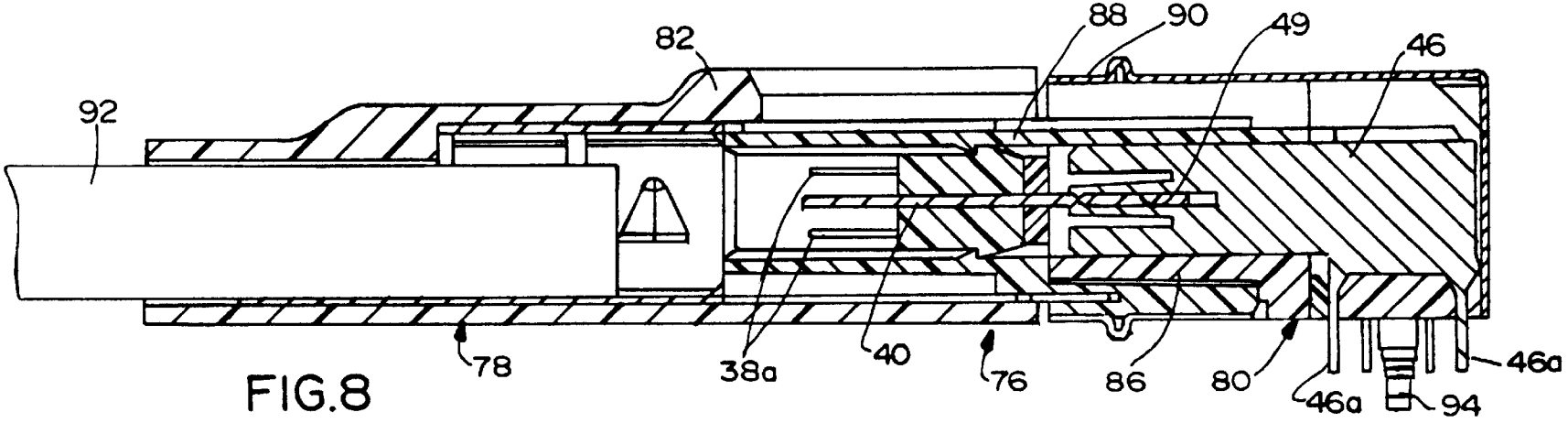
FIG. 8 is a section taken generally along line 8—8 of FIG. 7.
Figure 9:
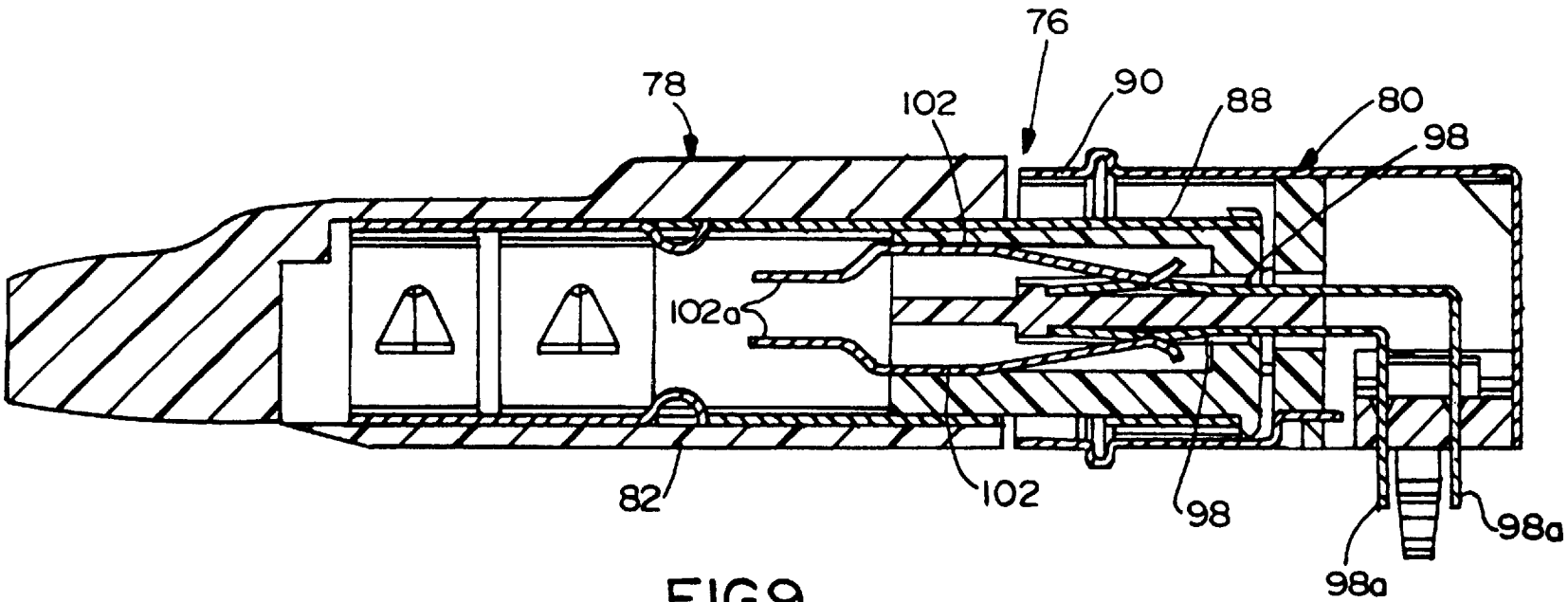
FIG. 9 is a section taken generally along line 9—9 of FIG. 7.
Figure 11:
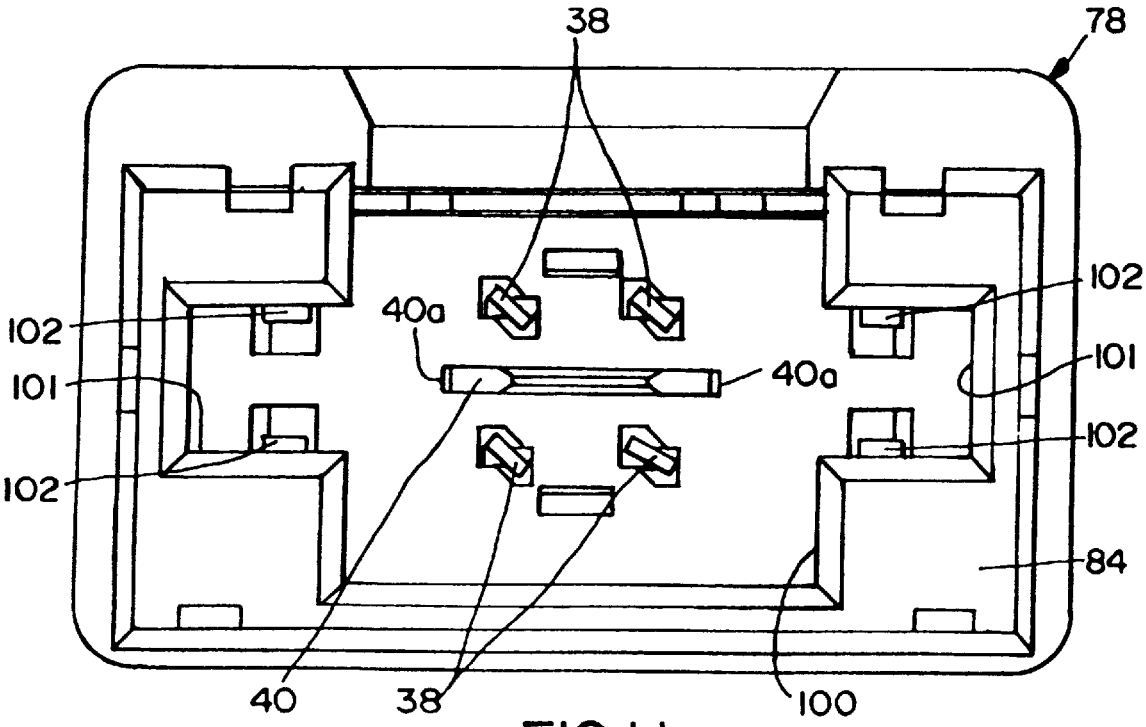
FIG. 11 is an end elevational view looking into the mating end of the plug connector in the embodiment of FIGS. 5 and 6.

Referring to FIGS. 6, 10 and 11, mating portion 84 of plug connector 78 includes a generally cross-shaped cavity 100 for receiving cross-shaped mating portion 86 of receptacle connector 80. In the alternative, the cavity could be described as generally rectangular with horizontally extending side openings 101. Signal pin terminals 38 project forwardly in openings 101, with two terminals on each opposite side of horizontal ground plate 40. Signal pin terminals 38 mate with signal female terminals 44 within mating portion 46 of receptacle connector 80. Terminals 38 have tail portions 38*a* for interconnection to wires (not shown) within cable 92. Terminals 44 have right-angled tail portions 44*a* for solder connection to signal circuit traces on the printed circuit board. This also is true with signal terminals 44 of connectors 18 and 54. A pair of outboard power terminals 102 are located outside each opposite edge 40*a* of ground plate 40 for mating with the two pairs of outboard power terminals 98 of receptacle connector 80, as clearly shown in FIG. 10. As best seen in FIG. 9, outboard terminals 102 of plug connector 78 are of a cantilevered spring type for engaging the recessed leaf-type terminals 98 of receptacle connector 80. Terminals 102 have tail portions 102*a* for interconnection with wires (not shown) of cable 92. Terminals 98 have right-angled tail portions 98*a* for solder connection to power circuit traces on the printed circuit board. This also is true with outboard power terminals 48 of connectors 18 and 54.

As stated above, the basic difference between the ground plane/terminal array of connector assembly 76 (FIGS. 5–11) versus the ground plane/terminal arrays in connector assemblies 14 and 50 (FIGS. 1–4) resides in the outboard terminals. In particular, connector assemblies 14 and 50 employ a single outboard terminal 42,48 outside opposite edges 48*a* of one of the ground plates 40, whereas connector assembly 76 employs a pair of outboard terminals 98, 102 outside each opposite edge of the ground plate. Nevertheless, both arrays are substantially effective to create a mutual coupling effect between the outboard terminals and the edges of one of the ground plates of the cross-shaped ground plate structure rather than the signal terminals within the quadrants of the ground plate structure, and thereby electrically isolates the outboard terminals from the terminals that are located in the quadrants of the cross-shaped ground plate structure.

While it is preferable to locate the outboard terminals in the same plane as the ground plates, as the outboard terminals are moved further from the quadrants of the ground plate structure, the necessity of such positioning is reduced. Thus, it can be seen that the outboard terminals 42,48 in FIGS. 3 and 4 are in the plane of ground plate 40. However, outboard terminals 98,102 in FIGS. 10 and 11 are spaced further from the quadrants of the cross-shaped ground structure and are spaced slightly above and below the plane of blade 40 and essentially equidistant from the plane of blade 40.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector for mating with a complementary connector along a mating axis, comprising:

a dielectric housing having a mating portion;

an outer conductive shield surrounding at least the mating portion of the housing;

a cross-shaped ground plate structure disposed in the mating portion of the housing when the electrical connector is mated with the complementary connector, the cross-shaped ground plate structure including a generally planar first plate and a generally planar second plate and defining four plate edges and four terminal quadrants;

at least one terminal mounted in the mating portion of the housing in at least one of said terminal quadrants defined by the cross-shaped ground plate structure; and first and second additional terminals mounted in the mating portion of the housing generally along the plane of said first plate and not within any of said four terminal quadrants, a first contact portion of said first additional terminal and a second contact portion of said second additional terminal being mounted on opposite sides of said second plate with said first contact portion being disposed generally between said shield and one of said plate edges of said first plate and said second contact portion being disposed generally between said shield and the other of said plate edges of said first plate.

2. The shielded electrical connector of claim 1, including a pair of first additional terminals mounted in the mating portion of the housing generally between said shield and one of said plate edges of said first plate and a pair of second additional terminals mounted in the mating portion of the housing generally between said shield and the other of said plate edges of said first plate.

3. The shielded electrical connector of claim 1 wherein said mating portion of said housing includes a generally rectangular base having a predetermined first thickness and a pair of wing portions having a predetermined second thickness and extending from opposite sides of said rectangular base, said second thickness being less than said first thickness, one of said first and second plates and said at least one terminal being mounted in said rectangular base and one of said first and second additional terminals being mounted along each of said wing portions.

4. The shielded electrical connector of claim 3, including a pair of first additional terminals mounted in the mating portion of the housing generally between said shield and one of said plate edges of said first plate and a pair of second additional terminals mounted in the mating portion of the housing generally between said shield and the other of said plate edges of said first plate.

5. The shielded electrical connector of claim 4 wherein the terminals in said pair of first additional terminals are located along opposite sides of one of said wing portions and the terminals in said pair of second additional terminals are located along opposite sides of the other of said wing portions.

6. A shielded electrical connector for mating with a complementary connector along a mating axis, comprising:

a dielectric housing having a mating portion;

an outer conductive shield surrounding at least the mating portion of the housing;

a cross-shaped ground plate structure disposed in the mating portion of the housing when the electrical connector is mated with the complementary connector, the cross-shaped ground plate structure including first and second transverse plates defining four plate edges and four quadrants;

at least one terminal mounted in the mating portion of the housing in at least one of the quadrants defined by the cross-shaped ground plate structure; and first and second outboard terminals mounted in the mating portion of the housing outside of said quadrants, a first contact portion of said first outboard terminal and a second contact portion of said second outboard terminal being located on opposite sides of said second plate with said first contact portion being disposed generally between said shield and one of said plate edges of said first plate and said second contact portion being disposed generally between said shield and the other of said plate edges of said first plate.

7. The shielded electrical connector of claim 6 wherein said mating portion of said housing includes a generally rectangular base having a predetermined first thickness and a pair of wing portions having a predetermined second thickness and extending from opposite sides of said rectangular base, said second thickness being less than said first thickness, said at least one terminal being mounted in said rectangular base and said first outboard being mounted along one of said wing portions and said second outboard terminal being mounted along the other of said wing portions.

8. The shielded electrical connector of claim 6, including a pair of first outboard terminals mounted in the mating portion of the housing generally between said shield and one of said plate edges of said first plate and a pair of second outboard terminals mounted in the mating portion of the housing generally between said shield and the other of said plate edges of said first plate.

9. The shielded electrical connector of claim 8, wherein each of said pair of first outboard terminals lying generally in the plane of said first plate and each of said pair of second outboard terminals lying generally in the plane of said first plate.

10. A shielded electrical connector for mating with a complementary connector along a mating axis, comprising:

a dielectric housing having a mating portion;

an outer conductive shield surrounding at least the mating portion of the housing, said mating portion of said housing including a generally rectangular base having a predetermined first thickness and a pair of wing portions having a predetermined second thickness and extending from opposite sides of said rectangular base, said second thickness being less than said first thickness;

a cross-shaped ground plate structure disposed in the mating portion of the housing when the electrical connector is mated with the complementary connector, the cross-shaped ground plate structure defining four plate edges and four quadrants;

at least one terminal mounted in the mating portion of the housing in at least some of the quadrants defined by the cross-shaped ground plate structure, said at least one terminal being mounted in said rectangular base; and two pairs of outboard terminals mounted in the mating portion of the housing, a contact portion of each outboard terminal being located generally between said shield and one of a pair of said opposite plate edges of the cross-shaped ground plate structure and the terminals of each pair of said outboard terminals being mounted along opposite sides of one of said wing portions.

11. The shielded electrical connector of claim 10, wherein said cross-shaped ground plate structure includes first and second generally planar ground plates, said first ground plate being generally perpendicular to said second ground plate, and said pairs of outboard terminals lying generally in the plane of said first ground plate.

12. An electrical connector for mating with a complementary connector, comprising:

a dielectric housing having a mating portion;

a cross-shaped ground plate structure disposed in the mating portion of the housing when the electrical connector is mated with the complementary connector, the cross-shaped ground plate structure including first and second plates defining four plate edges and four quadrants;

at least one terminal mounted in the mating portion of the housing in at least one of said quadrants defined by the cross-shaped ground plate structure; and first and second additional terminals mounted in the mating portion of the housing outside an opposite pair of the plate edges of said first plate of the cross-shaped ground plate structure, said first additional terminal being mounted on an opposite side of said second plate from said second additional terminal.

13. The electrical connector of claim 12 wherein each of said first additional terminals is offset from a plane extending between said pair of opposite plate edges of said first plate and each of said second additional terminals is offset from said plane.

14. The electrical connector of claim 12, including a pair,of first additional terminals mounted in the mating portion of the housing outside one of said pair of opposite first plate edges and a pair of second additional terminals mounted in the mating portion of the housing outside the other of said pair of opposite first plate edges.

15. The electrical connector of claim 14 wherein each of said pair of first additional terminals is located on opposite sides of a first wing portion of the mating portion of the dielectric housing and each of said pair of second additional terminals is located on opposite sides of a second wing portion of the mating portion of the dielectric housing.

16. An electrical connector for mating with a complementary connector, comprising:

a dielectric housing having a mating portion;

a cross-shaped ground plate structure disposed in the mating portion of the housing when the electrical connector is mated with the complementary connector, the cross-shaped ground plate structure including first and second plates defining four plate edges and four quadrants;

at least one terminal mounted in the mating portion of the housing in each of said quadrants defined by the cross-shaped ground plate structure; and first and second outboard terminals mounted in the mating portion of the housing outside an opposite pair of the plate edges of said first plate of the cross-shaped ground plate structure, said first outboard terminal being mounted on an opposite side of said second plate from said second outboard terminal.

17. The electrical connector of claim 16, including a pair of first outboard terminals mounted in the mating portion of the housing outside one of said plate edges and a pair of second outboard terminals mounted in the mating portion of the housing outside the other of said plate edges.

18. The electrical connector of claim 17 wherein each of said pair of first additional terminals is located on opposite sides of a first wing portion of the mating portion of the dielectric housing and each of said pair of second additional terminals is located on opposite sides of a second wing portion of the mating portion of the dielectric housing.

* * * * *